US011571600B1

(12) United States Patent
Stone

(10) Patent No.: US 11,571,600 B1
(45) Date of Patent: Feb. 7, 2023

(54) EXERCISE DEVICES FOR MUSCLE ISOLATION

(71) Applicant: Doniphan T. Stone, Denver, CO (US)

(72) Inventor: Doniphan T. Stone, Denver, CO (US)

(73) Assignee: CoreFirstX, LLC, Aurora, CO (US)

( * ) Notice: Subject to any disclaimer, the term of this patent is extended or adjusted under 35 U.S.C. 154(b) by 121 days.

(21) Appl. No.: 16/543,771

(22) Filed: Aug. 19, 2019

Related U.S. Application Data

(60) Provisional application No. 62/720,291, filed on Aug. 21, 2018.

(51) Int. Cl.

| | |
|---|---|
| ***A63B 21/002*** | (2006.01) |
| ***A63B 21/068*** | (2006.01) |
| ***A63B 21/00*** | (2006.01) |
| ***A63B 21/04*** | (2006.01) |
| ***A63B 21/08*** | (2006.01) |
| ***A63B 21/16*** | (2006.01) |

(52) U.S. Cl.
CPC ..... *A63B 21/0023* (2013.01); *A63B 21/068* (2013.01); *A63B 21/4025* (2015.10); *A63B 21/04* (2013.01); *A63B 21/08* (2013.01); *A63B 21/151* (2013.01); *A63B 21/1663* (2013.01); *A63B 21/4001* (2015.10); *A63B 2225/09* (2013.01)

(58) Field of Classification Search
CPC ..... A63B 21/00043; A63B 21/00185; A63B 21/0023; A63B 21/04; A63B 21/068; A63B 21/08; A63B 21/4025; A63B 2225/09; A63B 69/0057; A63B 21/4001; A63B 21/4013; A63B 21/4021
See application file for complete search history.

(56) References Cited

U.S. PATENT DOCUMENTS 4,478,414 A * 10/1984 Molloy ..... A63B 21/1609 482/123
4,809,974 A 3/1989 Buhr
(Continued)

FOREIGN PATENT DOCUMENTS

WO 2011/082043 A2 7/2011

OTHER PUBLICATIONS

Webpage: "www.ironmind-store.com", IronMind, Strong-Enough Lifting Straps for Strongman, WSM, Nevada City, CA, retrieved Aug. 14, 2019.
(Continued)

*Primary Examiner* — Jennifer Robertson
(74) *Attorney, Agent, or Firm* — Koliasch Hartwell, P.C.

(57) ABSTRACT

Methods and devices for isolating muscle groups during exercise are provided. According to an aspect of the invention, a device includes a first strap that has a first loop shape, a second strap that has a second closed loop shape defining a fixed opening, and a third strap that has a third closed loop shape. A first portion of the first strap is affixed to or integral with the second strap, a second portion of the first strap is arranged to be movable within the fixed opening defined by the second closed loop shape, the second portion of the first strap is affixed to or integral with the third strap, and a first adjustable opening within the first loop shape is configured to be adjusted by changing a relative position of the second portion of the first strap and the fixed opening defined by the second closed loop shape.

22 Claims, 6 Drawing Sheets

(56) References Cited

U.S. PATENT DOCUMENTS

| | | | | |
|---|---|---|---|---|
| 5,372,557 | A | 12/1994 | Ostigny | |
| 5,873,805 | A | 2/1999 | Ayres et al. | |
| 5,967,947 | A | 10/1999 | Glover | |
| 6,168,556 | B1 | 1/2001 | Saavedra | |
| 7,044,896 | B2 | 5/2006 | Hetrick | |
| 7,090,622 | B2 | 8/2006 | Hetrick | |
| 7,651,448 | B2 | 1/2010 | Hetrick | |
| 7,662,073 | B1 * | 2/2010 | Baldwin | A63B 21/4021 482/92 |
| 7,722,508 | B2 | 5/2010 | Hetrick | |
| 7,762,932 | B2 | 7/2010 | Hetrick | |
| 7,785,244 | B2 | 8/2010 | Hetrick | |
| 7,806,814 | B2 | 10/2010 | Hetrick | |
| 8,043,197 | B2 | 10/2011 | Hetrick | |
| 8,083,653 | B2 | 12/2011 | Hetrick | |
| 8,469,864 | B2 | 6/2013 | Hetrick | |
| 8,840,532 | B2 | 9/2014 | Hetrick et al. | |
| 9,155,931 | B2 | 10/2015 | Hetrick | |
| 9,433,258 | B2 | 9/2016 | Hetrick et al. | |
| 9,895,566 | B2 * | 2/2018 | Zbinden | A63B 21/068 |
| 10,105,275 | B2 * | 10/2018 | Zbinden | A63B 21/4015 |
| 10,245,460 | B2 | 4/2019 | Hetrick et al. | |
| 2013/0143724 | A1 | 6/2013 | DeMeo | |
| 2014/0213420 | A1 | 7/2014 | Harris | |
| 2017/0368406 | A1 | 12/2017 | Parent, Jr. | |
| 2018/0140884 | A1 * | 5/2018 | Johnson | A63B 21/4023 |
| 2018/0290007 | A1 | 10/2018 | Vorozilchak | |
| 2019/0091507 | A1 | 3/2019 | Hetrick et al. | |

OTHER PUBLICATIONS

U.S. Patent and Trademark Office, Non-Final Office Action regarding U.S. Appl. No. 17/125,944, dated May 2, 2022, 15 pages.

* cited by examiner

EXERCISE DEVICES FOR MUSCLE ISOLATION

CROSS-REFERENCE TO RELATED APPLICATION

This application claims priority under 35 U.S.C. § 119 to U.S. Provisional Patent Application No. 62/720,291, filed on Aug. 21, 2018, the contents of which are hereby incorporated by reference in their entirety for all purposes.

BACKGROUND

This disclosure relates in general to exercise devices. More specifically, this disclosure relates to devices and methods that isolate muscle groups during exercise.

For example, in exercises where the user must use forearm strength, tendons, and joints to stabilize and perform the exercise movement, there is much stress on all joints and ligaments. In addition, the stress load on the forearm muscles may be too great to complete a set of the exercise in which the intended muscle group is stressed to satisfaction.

Some related art exercise devices require the user to grip a weight in order to perform an exercise. Other related art exercise devices do not allow the wrist to have free range of motion, and/or require the user to tightly secure a strap to the wrist. Typical wrist straps were designed for only dead lifts or where grip strength hinders workload. Other wrist straps focus on stabilizing the wrist to prevent injury.

SUMMARY

Exemplary embodiments of the invention provide devices and methods for isolating muscle groups during exercise. According to an aspect of the invention, a device includes a first strap that has a first loop shape, a second strap that has a second closed loop shape defining a fixed opening, and a third strap that has a third closed loop shape. A first portion of the first strap is affixed to or integral with the second strap, a second portion of the first strap is arranged to be movable within the fixed opening defined by the second closed loop shape, the second portion of the first strap is affixed to or integral with the third strap, and a first adjustable opening within the first loop shape is configured to be adjusted by changing a relative position of the second portion of the first strap and the fixed opening defined by the second closed loop shape.

A size of the first adjustable opening within the first loop shape may be configured to be increased by moving the second portion of the first strap through the fixed opening defined by the second closed loop shape in a first direction, and the size of the first adjustable opening within the first loop shape may be configured to be decreased by moving the second portion of the first strap through the fixed opening defined by the second closed loop shape in a second direction that is different from the first direction. A size of a second adjustable opening within the first loop shape may be configured to be decreased by moving the second portion of the first strap through the fixed opening defined by the second closed loop shape in the first direction, and the size of the second adjustable opening defined by the first loop shape may be configured to be increased by moving the second portion of the first strap through the fixed opening defined by the second closed loop shape in the second direction. The second direction may be opposite to the first direction.

The first strap may include nylon, cotton, polyester, and/or leather. Similarly, the second strap may include nylon, cotton, polyester, and/or leather.

The device may also include a flexible material that covers a section of the second portion of the first strap. The section of the second portion of the first strap may be adjacent to the first adjustable opening. The flexible material may include neoprene. A surface of the flexible material that faces the first adjustable opening may be smooth.

The second portion of the first strap may be integral with the third strap. The third closed loop shape may be configured to receive a connector. The connector may be a hook, a clip, and/or a carabineer.

The third closed loop shape may be formed by attaching the second portion of the first strap to a third portion of the first strap. The second closed loop shape may be secured by a stitching. The second closed loop shape may be secured by a metal snap fastener. The first adjustable opening may be configured to accommodate an appendage of a body when the first adjustable opening is adjusted to a minimum size.

According to another aspect of the invention, a method includes adjusting a first adjustable opening within a first loop shape of a first strap by changing a relative position of the first strap with respect to a fixed opening defined by a second closed loop shape of a second strap. A first portion of the first strap is attached to or integral with the second strap, a second portion of the first strap is arranged to be movable within the fixed opening defined by the second closed loop shape of the second strap, and adjusting the first adjustable opening comprises applying a force to a third closed loop shape that is affixed to or integral with the second portion of the first strap.

Adjusting the first adjustable opening may also include increasing a size of the first adjustable opening within the first loop shape of the first strap by moving the second portion of the first strap through the fixed opening defined by the second closed loop shape in a first direction. Adjusting the first adjustable opening may also include decreasing a size of the first adjustable opening within the first loop shape of the first strap by moving the second portion of the first strap through the fixed opening defined by the second closed loop shape in a second direction. The force may be applied through a connector that is connected to the third closed loop shape of the third strap.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

The present disclosure is described in conjunction with the appended figures.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability or configuration of the disclosure. Rather, the ensuing description of the preferred exemplary embodiment(s) will provide those skilled in the art with an enabling description for implementing a preferred exemplary embodiment. It is understood that various changes may be made in the function and arrangement of elements without departing from the spirit and scope as set forth in the appended claims.

Exemplary embodiments of the invention provide devices that isolate the muscle groups of a user during exercise. By isolating the stress of the exercise to the intended muscle group and alleviating the stress load of the weight on the forearms, elbows, and shoulder joints, the devices effectively eliminate the need to use the hands and forearms. Further, the devices eliminate the reliance on grip strength for performing the exercise.

Figure 1:
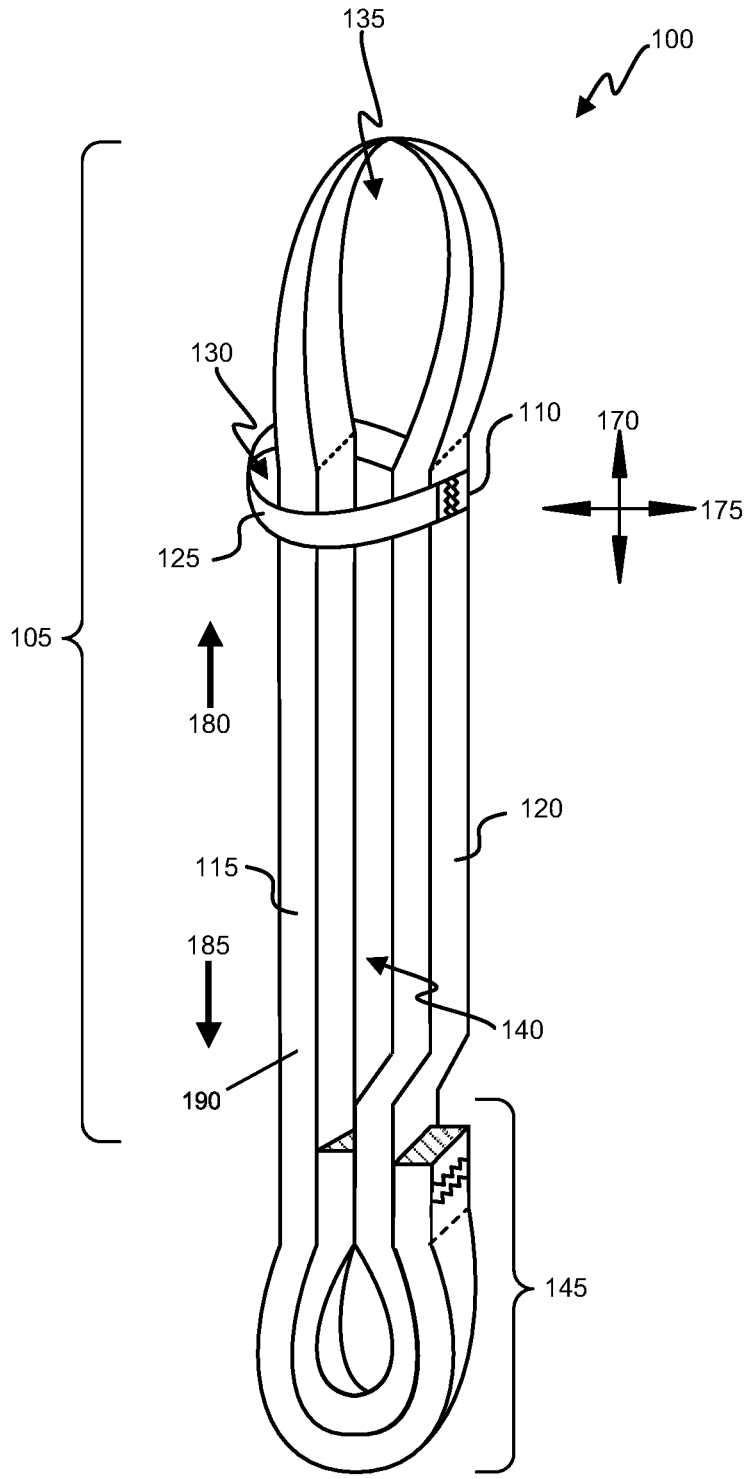
FIG. 1 shows an example of an exercise device according to exemplary embodiments of the invention.

FIG. 1 shows an example of an exercise device 100 according to exemplary embodiments of the invention. As shown in FIG. 1, the exercise device 100 includes a first strap 105 that has a first portion 110, a second portion 115, and a third portion 120. The first portion 110, the second portion 115, and the third portion 120 of the first strap 105 together form a first closed loop shape. The first strap 105 may be made of a flexible material, such as nylon, cotton, polyester, and/or leather. The flexible material may have sufficient strength to withstand a force that is applied while using the exercise device 100 to perform an exercise.

The first portion 110 of the first strap 105 may be affixed to a second strap 125 that forms a second closed loop shape. The first portion of the first strap 105 may be affixed to the second strap 125 by a fastener, such as stitching and/or glue. The fastener may extend over an entire vertical length of the second strap 125. The second portion 115 of the first strap 105 may extend from the top edge of the first portion 110 of the first strap 105 to a junction with a third strap 145. The third portion 120 of the first strap 105 may extend from the bottom edge of the first portion 110 of the first strap 105 to the junction with the third strap 145.

The second strap 125 may be made of a flexible material, such as nylon, cotton, polyester, and/or leather. The second closed loop shape of the second strap 125 may be secured by a fastener, such as stitching and/or a metal snap. For example, two ends of the second closed loop shape of the second strap 125 may be stitched together or held together by a metal snap with a male component on the first end of the second closed loop shape of the second strap 125 and a female component on the second end of the second closed loop shape of the second strap 125. Alternatively, any other fastener that is capable of fastening the first end of the second closed loop shape of the second strap 125 to the second end of the second closed loop shape of the second strap 125 may be used.

The second closed loop shape of the second strap 125 may define a fixed opening 130. Once the first end of the second closed loop shape of the second strap 125 has been affixed to the second end of the second closed loop shape of the second strap 125, the shape of the fixed opening 130 is constrained by the extent of the second closed loop shape of the second strap 125. Because the second strap 125 may be made of a flexible material, the shape of the fixed opening 130 may be altered somewhat by applying pressure to a portion of the second strap 125, such as by squeezing opposing portions of the second closed loop shape of the second strap 125 together. However, the basic shape and size of the fixed opening 130 may remain the same as determined by the length of the second closed loop shape of the second strap 125.

The second strap 125 may be affixed to the first portion 110 of the first strap 105 such that the second strap 125 is arranged in a plane that is generally perpendicular to a first axis 170, as shown in FIG. 1. The first axis 170 may be parallel to the vertical axis of the device 100. Alternatively, the second strap 125 may be affixed to the first portion 110 of the first strap 105 such that the second strap 125 is arranged in a plane that is generally perpendicular to a second axis 175 and parallel to the first axis 170.

The second portion 115 of the first strap 105 and the third portion 120 of the first strap 105 may be affixed to or integrated with the third strap 145, which forms a third closed loop shape. The second portion 115 of the first strap 105 and the third portion 120 of the first strap 105 may be affixed to the third strap 145 by fasteners, such as stitching and/or glue. The fasteners may extend over a portion of the vertical length of the third strap 145. Alternatively, the second portion 115 of the first strap 105 and/or the third portion 120 of the first strap 105 may form the third strap 145, as shown in FIG. 1.

The third strap 145 may be made of a flexible material, such as nylon, cotton, polyester, and/or leather. The flexible material may have sufficient strength to withstand a force that is applied while using the exercise device 100 to perform an exercise. The third closed loop shape of the third strap 145 may be secured by a fastener, such as stitching and/or a metal snap. For example, two ends of the third closed loop shape of the third strap 145 may be stitched together or held together by a metal snap with a male component on the first end of the third closed loop shape of the third strap 145 and a female component on the second end of the third closed loop shape of the third strap 145. Alternatively, any other fastener that is capable of fastening the first end of the third closed loop shape of the third strap 145 to the second end of the third closed loop shape of the third strap 145 may be used.

The third closed loop shape may be formed by attaching the second portion 115 of the first strap 105 to the third portion 120 of the first strap 105. For example, the end of the third portion 120 of the first strap 105 may be looped around and affixed to another section of the third portion 120 of the first strap 105 to form an inner portion of the third closed loop shape. Further, the end of the second portion 115 of the first strap 105 may be looped around and affixed to the third portion 120 of the first strap 105 to form an outer portion of the third closed loop shape that is adjacent to the inner portion of the third closed loop shape.

The second portion 115 of the first strap 105 may be threaded through the fixed opening 130 defined by the second closed loop shape of the second strap 125. The second portion 115 of the first strap 105 is not attached to the second strap 125. Instead, the second portion 115 of the first strap 105 is arranged to be movable within the fixed opening 130 defined by the second closed loop shape of the second strap 125.

The first loop shape of the first strap 105 may define a first adjustable opening 135 and a second adjustable opening 140. The size and shape of the first adjustable opening 135 and the second adjustable opening 140 may be adjusted by moving the second portion 115 of the first strap 105 with respect to the fixed opening 130 defined by the second closed loop shape of the second strap 125. Alternatively or in addition, the size and shape of the first adjustable opening 135 and the second adjustable opening 140 may be adjusted by moving the fixed opening 130 defined by the second closed loop shape of the second strap 125 with respect to the second portion 115 of the first strap 105. As the size of the first adjustable opening 135 increases, the size of the second adjustable opening 140 decreases proportionally. Similarly, as the size of the first adjustable opening 135 decreases, the size of the second adjustable opening 140 increases proportionally.

For example, the size of the first adjustable opening 135 may be increased by moving the second portion 115 of the first strap 105 through the fixed opening 130 defined by the second closed loop shape of the second strap 125 in a first direction 180. This causes a corresponding decrease in the size of the second adjustable opening 140.

Similarly, the size of the first adjustable opening 135 may be decreased by moving the second portion 115 of the first strap 105 through the fixed opening 130 defined by the second closed loop shape of the second strap 125 in a second direction 185 that is different from the first direction 180. This causes a corresponding increase in the size of the second adjustable opening 140. The second direction 185 may be opposite to the first direction 180. A force may be applied in the second direction 185 via the third closed loop shape of the third strap 145. For example, the force may adjust the size of the first adjustable opening 135 such that the portion of the first strap 105 defining the first adjustable opening 135 fits securely around an appendage of a user that has been inserted through the first adjustable opening 135. Second portion 115 of first strap 105 and the third closed loop shape of the third strap 145 provide a path 190. As discussed below for FIGS. 2-3 and 5-6, a connector may be connected to the third closed loop shape for coupling to additional exercise equipment. The force applied from the wrist or ankle of the user is transmitted along path 190 to the additional exercise equipment. The force moves second portion 115 of first strap 105 within fixed opening 130 defined by the second closed loop shape to tighten the first adjustable opening 135 on the wrist or ankle of the user, eliminating the need to use the hand.

The first adjustable opening 135 may be configured to accommodate an appendage of a user when the first adjustable opening 135 is adjusted to a minimum size. For example, the first adjustable opening 135 may be configured to accommodate a wrist, ankle, foot, or neck of the user. The length of the first strap 105 and/or the location of the first portion 110 of the first strap 105 where the second strap 125 is affixed may define a range of minimum sizes of the first adjustable opening 135. Because the first strap 105 can be made longer or shorter, and the location where the second strap 125 may be affixed to the first strap 105 can be varied, appendages having different sizes can be accommodated.

Figure 2:
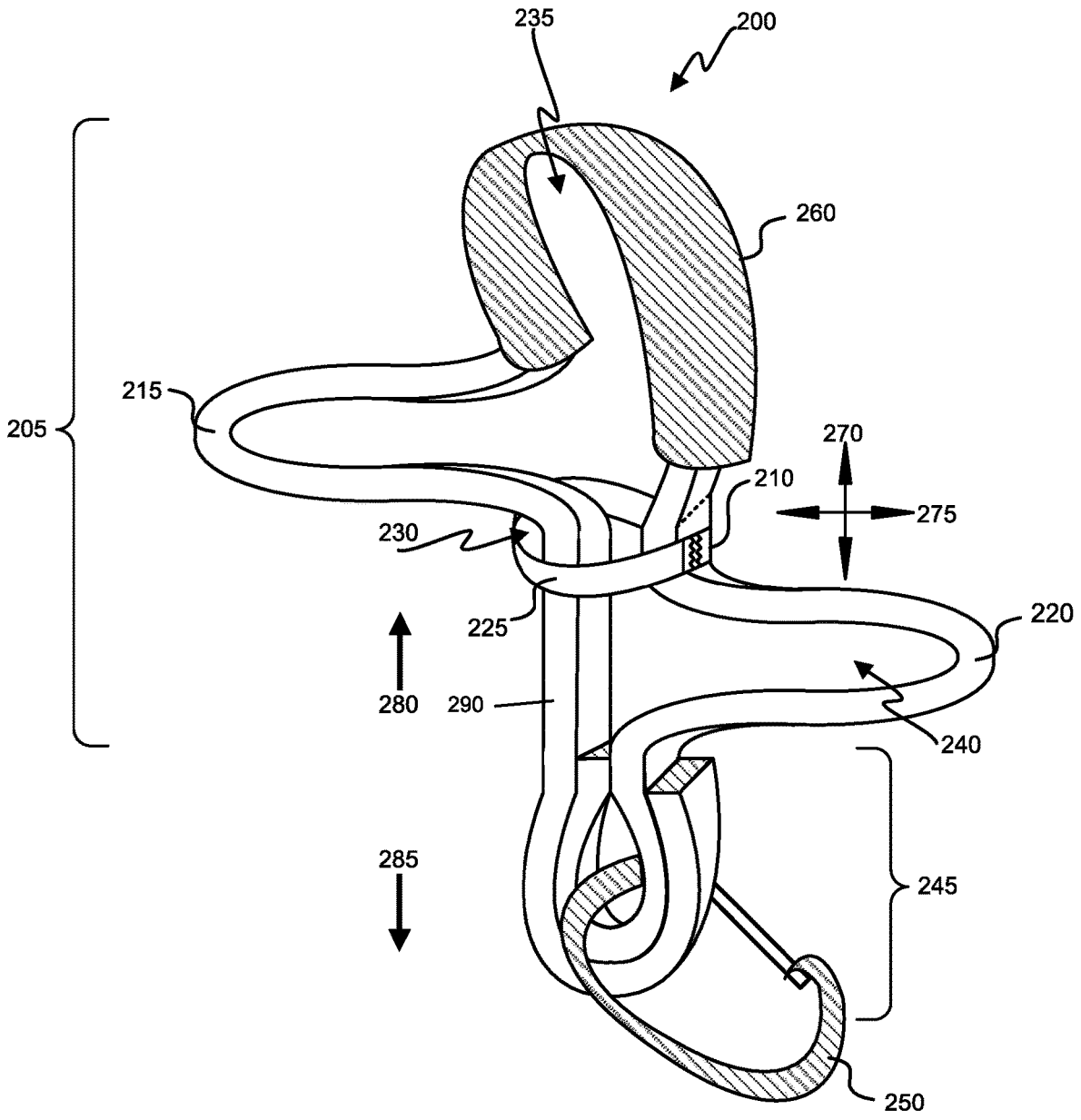
FIG. 2 shows an example of another exercise device according to exemplary embodiments of the invention.

FIG. 2 shows an example of another exercise device 200 according to exemplary embodiments of the invention. As shown in FIG. 2, the exercise device 200 includes a first strap 205 that has a first portion 210, a second portion 215, and a third portion 220. The first portion 210, the second portion 215, and the third portion 220 of the first strap 205 together form a first closed loop shape. The first strap 205 may be made of a flexible material, such as nylon, cotton, polyester, and/or leather. The flexible material may have sufficient strength to withstand a force that is applied while using the exercise device 200 to perform an exercise.

The first portion 210 of the first strap 205 may be affixed to a second strap 225 that forms a second closed loop shape. The first portion of the first strap 205 may be affixed to the second strap 225 by a fastener, such as stitching and/or glue. The fastener may extend over an entire vertical length of the second strap 225. The second portion 215 of the first strap 105 may extend from the top edge of the first portion 210 of the first strap 205 to a junction with a third strap 245. The third portion 220 of the first strap 205 may extend from the bottom edge of the first portion 210 of the first strap 205 to the junction with the third strap 245.

The second strap 225 may be made of a flexible material, such as nylon, cotton, polyester, and/or leather. The second closed loop shape of the second strap 225 may be secured by a fastener, such as stitching and/or a metal snap. For example, two ends of the second closed loop shape of the second strap 225 may be stitched together or held together by a metal snap with a male component on the first end of the second closed loop shape of the second strap 225 and a female component on the second end of the second closed loop shape of the second strap 225. Alternatively, any other fastener that is capable of fastening the first end of the second closed loop shape of the second strap 225 to the second end of the second closed loop shape of the second strap 225 may be used.

The second closed loop shape of the second strap 225 may define a fixed opening 230. Once the first end of the second closed loop shape of the second strap 225 has been affixed to the second end of the second closed loop shape of the second strap 225, the shape of the fixed opening 230 is constrained by the extent of the second closed loop shape of the second strap 225. Because the second strap 225 may be made of a flexible material, the shape of the fixed opening 230 may be altered somewhat by applying pressure to a portion of the second strap 225, such as by squeezing opposing portions of the second closed loop shape of the second strap 225 together. However, the basic shape and size of the fixed opening 230 may remain the same as determined by the length of the second closed loop shape of the second strap 225.

The second strap 225 may be affixed to the first portion 210 of the first strap 205 such that the second strap 225 is arranged in a plane that is generally perpendicular to a first axis 270, as shown in FIG. 2. The first axis 270 may be parallel to the vertical axis of the device 200. Alternatively, the second strap 225 may be affixed to the first portion 210 of the first strap 205 such that the second strap 225 is arranged in a plane that is generally perpendicular to a second axis 275 and parallel to the first axis 170.

The second portion 215 of the first strap 205 and the third portion 220 of the first strap 205 may be affixed to or integrated with the third strap 245, which forms a third closed loop shape. The second portion 215 of the first strap 205 and the third portion 220 of the first strap 205 may be affixed to the third strap 245 by fasteners, such as stitching and/or glue. The fasteners may extend over a portion of the vertical length of the third strap 245. Alternatively, the second portion 215 of the first strap 205 and/or the third portion 220 of the first strap 205 may form the third strap 245, as shown in FIG. 2. The third closed loop shape may be configured to receive a connector 250 such as a hook, clip, and/or carabineer. The connector 250 may be used to connect the exercise device 200 to exercise equipment such as dumbbells, barbells, plates, and/or chains.

The third strap 245 may be made of a flexible material, such as nylon, cotton, polyester, and/or leather. The flexible material may have sufficient strength to withstand a force that is applied while using the exercise device 200 to perform an exercise. The third closed loop shape of the third strap 245 may be secured by a fastener, such as stitching and/or a metal snap. For example, two ends of the third closed loop shape of the third strap 245 may be stitched together or held together by a metal snap with a male component on the first end of the third closed loop shape of the third strap 245 and a female component on the second end of the third closed loop shape of the third strap 245. Alternatively, any other fastener that is capable of fastening the first end of the third closed loop shape of the third strap 245 to the second end of the third closed loop shape of the third strap 245 may be used.

The third closed loop shape may be formed by attaching the second portion 215 of the first strap 205 to the third portion 220 of the first strap 205. For example, the end of the third portion 220 of the third strap 205 may be looped around and affixed to another section of the third portion 220 of the first strap 205 to form an inner portion of the third closed loop shape. Further, the end of the second portion 215 of the first strap 205 may be looped around and affixed to the third portion 220 of the first strap 205 to form an outer portion of the third closed loop shape that is adjacent to the inner portion of the third closed loop shape.

The second portion 215 of the first strap 205 may be threaded through the fixed opening 230 defined by the second closed loop shape of the second strap 225. The second portion 215 of the first strap 205 is not attached to the second strap 225. Instead, the second portion 215 of the first strap 205 is arranged to be movable within the fixed opening 230 defined by the second closed loop shape of the second strap 225.

The first loop shape of the first strap 205 may define a first adjustable opening 235 and a second adjustable opening 240. The size and shape of the first adjustable opening 235 and the second adjustable opening 240 may be adjusted by moving the second portion 215 of the first strap 205 with respect to the fixed opening 230 defined by the second closed loop shape of the second strap 225. Alternatively or in addition, the size and shape of the first adjustable opening 235 and the second adjustable opening 240 may be adjusted by moving the fixed opening 230 defined by the second closed loop shape of the second strap 225 with respect to the second portion 215 of the first strap 205. As the size of the first adjustable opening 235 increases, the size of the second adjustable opening 240 decreases proportionally. Similarly, as the size of the first adjustable opening 235 decreases, the size of the second adjustable opening 240 increases proportionally.

For example, the size of the first adjustable opening 235 may be increased by moving the second portion 215 of the first strap 205 through the fixed opening 230 defined by the second closed loop shape of the second strap 225 in a first direction 280. This causes a corresponding decrease in the size of the second adjustable opening 240.

Similarly, the size of the first adjustable opening 235 may be decreased by moving the second portion 215 of the first strap 205 through the fixed opening 230 defined by the second closed loop shape of the second strap 225 in a second direction 285 that is different from the first direction 280. This causes a corresponding increase in the size of the second adjustable opening 240. The second direction 285 may be opposite to the first direction 280. A force may be applied in the second direction 285 via the third closed loop shape of the third strap 245. For example, the force may adjust the size of the first adjustable opening 235 such that the portion of the first strap 205 defining the first adjustable opening 235 fits securely around an appendage of a user that has been inserted through the first adjustable opening 235. The force may be applied via the connector 250 that is connected to the third strap 245. Second portion 215 of first strap 205 and the third closed loop shape of the third strap 245 provide a path 290 from connector 250 when coupled to the additional exercise equipment. The force applied from the wrist or ankle of the user is transmitted along path 290 to the additional exercise equipment. The force moves second portion 215 of first strap 205 within fixed opening 230 defined by the second closed loop shape to tighten the first adjustable opening 235 on the wrist or ankle of the user, eliminating the need to use the hand.

The first adjustable opening 235 may be configured to accommodate an appendage of a user when the first adjustable opening 235 is adjusted to a minimum size. For example, the first adjustable opening 235 may be configured to accommodate a wrist, ankle, foot, or neck of the user. The length of the first strap 205 and/or the location of the first portion 210 of the first strap 205 where the second strap 225 is affixed may define a range of minimum sizes of the first adjustable opening 235. Because the first strap 205 can be made longer or shorter, and the location where the second strap 225 may be affixed to the first strap 205 can be varied, appendages having different sizes can be accommodated.

As shown in FIG. 2, the exercise device 200 may include a flexible material 260 that covers a section of the second portion 215 of the first strap 205. The flexible material 260 may include a padded material such as neoprene, foam, and/or rubber. The flexible material 260 may cover a section of the second portion 215 of the first strap 205 that is adjacent to the first adjustable opening 235. For example, the flexible material 260 may extend along a section of the second portion 215 of the first strap 205 starting from the top of the first portion 210 of the first strap 205. Alternatively, the flexible material 260 may cover a larger portion or an entire length of the first strap 205, and may contain a slit (not shown) through which the first strap 205 is threaded. The flexible material 260 may have a length that allows access to the third closed loop shape of the third strap 245. A surface of the flexible material 260 that faces the first adjustable opening 235 may be smooth.

The flexible material 260 may be affixed to the second portion 215 of the first strap 205 by a fastener, such as stitching and/or glue. The flexible material 260 may be affixed to the second portion 215 of the first strap 205 at a single location adjacent to the first portion 210 of the first strap 205. Alternatively or in addition, the flexible material 260 may be affixed to the second portion 215 of the first strap 205 at multiple locations.

Figure 3:
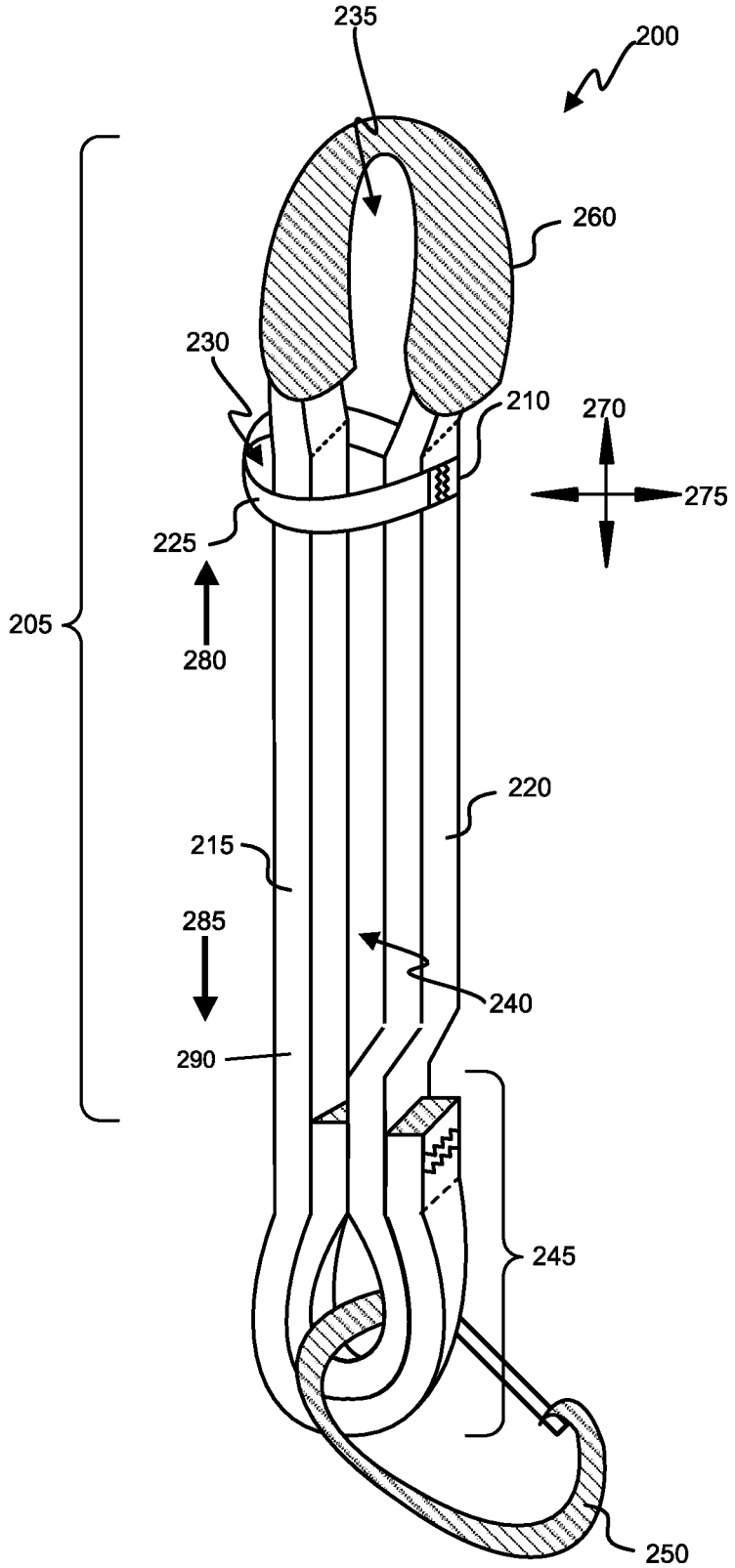
FIG. 3 shows an example of the exercise device of FIG. 2 in another configuration.

FIG. 3 shows an example of the exercise device 200 shown in FIG. 2 in another configuration. As shown in FIG. 3, the first adjustable opening 235 has a reduced size compared with the first adjustable opening 235 in FIG. 2. In addition, the second adjustable opening 240 has an increased size compared with the second adjustable opening 240 in FIG. 2. The first adjustable opening 235 may have been decreased by moving the second portion 215 of the first strap 205 through the fixed opening 230 defined by the second closed loop shape along the second direction 285. The second portion 215 of the first strap 205 may have been moved through the fixed opening 230 defined by the second closed loop shape along the second direction 285 by applying a force to the third closed loop shape of the third strap 245. Alternatively or in addition, the force may have been applied through the connector 250 that is connected to the third closed loop shape of the third strap 245.

Figure 4:
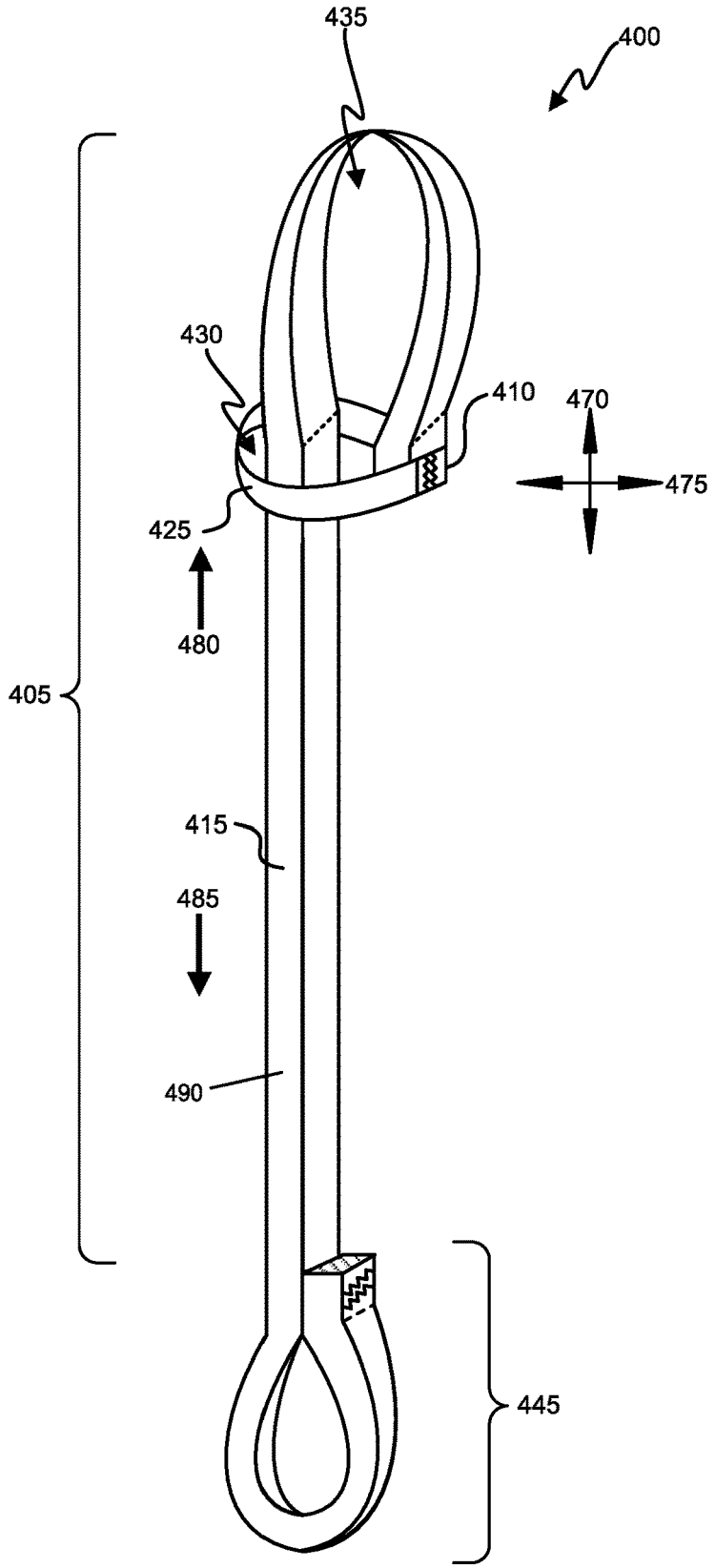
FIG. 4 shows an example of another exercise device according to exemplary embodiments of the invention.

FIG. 4 shows an example of another exercise device 400 according to exemplary embodiments of the invention. As shown in FIG. 4, the exercise device 400 includes a first strap 405 that has a first portion 410 and a second portion 415. The first portion 410 and/or the second portion 415 of the first strap 405 may form a first loop shape. The first loop shape may include an opening. The first strap 405 may be made of a flexible material, such as nylon, cotton, polyester, and/or leather. The flexible material may have sufficient strength to withstand a force that is applied while using the exercise device 400 to perform an exercise.

The first portion 410 of the first strap 405 may be affixed to a second strap 425 that forms a second closed loop shape, as shown in FIG. 4. The first portion of the first strap 405 may be affixed to the second strap 425 by a fastener, such as stitching and/or glue. The fastener may extend over an entire vertical length of the second strap 425. The second portion 415 of the first strap 405 may extend from the top edge of the first portion 410 of the first strap 405 to a junction with a third strap 445.

Alternatively, the first portion 410 of the first strap 405 may be integral with the second strap 425. In this example, the second strap 425 is a continuation of the first portion 410 of the first strap 405. The second closed loop shape may be formed by looping the end of the first portion 410 of the first strap 405 around the second portion 415 of the first strap 405, and affixing the end of the first portion 410 of the first strap 405 to another section of the first portion 410 of the first strap 405. Further, the end of the first portion 410 of the first strap 405 may be affixed to the other section of the first portion 410 of the first strap 405 by a fastener, such as stitching and/or glue.

The second strap 425 may be made of a flexible material, such as nylon, cotton, polyester, and/or leather. The second closed loop shape of the second strap 425 may be secured by a fastener, such as stitching and/or a metal snap. For example, two ends of the second closed loop shape of the second strap 425 may be stitched together or held together by a metal snap with a male component on the first end of the second closed loop shape of the second strap 425 and a female component on the second end of the second closed loop shape of the second strap 425. Alternatively, any other fastener that is capable of fastening the first end of the second closed loop shape of the second strap 425 to the second end of the second closed loop shape of the second strap 425 may be used.

The second closed loop shape of the second strap 425 may define a fixed opening 430. Once the first end of the second closed loop shape of the second strap 425 has been affixed to the second end of the second closed loop shape of the second strap 425, the shape of the fixed opening 430 is constrained by the extent of the second closed loop shape of the second strap 425. Because the second strap 425 may be made of a flexible material, the shape of the fixed opening 430 may be altered somewhat by applying pressure to a portion of the second strap 425, such as by squeezing opposing portions of the second closed loop shape of the second strap 425 together. However, the basic shape and size of the fixed opening 430 may remain the same as determined by the length of the second closed loop shape of the second strap 425.

The second strap 425 may be affixed to the first portion 410 of the first strap 405 such that the second strap 425 is arranged in a plane that is generally perpendicular to a first axis 470, as shown in FIG. 4. The first axis 470 may be parallel to the vertical axis of the device 400. Alternatively, the second strap 425 may be affixed to the first portion 410 of the first strap 405 such that the second strap 425 is arranged in a plane that is generally perpendicular to a second axis 475 and parallel to the first axis 470.

The second portion 415 of the first strap 405 may be affixed to or integrated with the third strap 445, which forms a third closed loop shape. The second portion 415 of the first strap 405 may be affixed to the third strap 445 by fasteners, such as stitching and/or glue. The fasteners may extend over a portion of the vertical length of the third strap 445. Alternatively, the second portion 415 of the first strap 405 may form the third strap 145, as shown in FIG. 1.

The third strap 445 may be made of a flexible material, such as nylon, cotton, polyester, and/or leather. The flexible material may have sufficient strength to withstand a force that is applied while using the exercise device 400 to perform an exercise. The third closed loop shape of the third strap 445 may be secured by a fastener, such as stitching and/or a metal snap. For example, two ends of the third closed loop shape of the third strap 445 may be stitched together or held together by a metal snap with a male component on the first end of the third closed loop shape of the third strap 445 and a female component on the second end of the third closed loop shape of the third strap 445. Alternatively, any other fastener that is capable of fastening the first end of the third closed loop shape of the third strap 445 to the second end of the third closed loop shape of the third strap 445 may be used.

The third closed loop shape may be formed by looping the end of the second portion 415 of the first strap 405 and affixing the end of the second portion 415 of the first strap 405 to another section of the second portion 415 of the first strap 405. Further, the end of the second portion 415 of the first strap 405 may be affixed to the other section of the second portion 415 of the first strap 405 by a fastener, such as stitching and/or glue.

The second portion 415 of the first strap 405 may be threaded through the fixed opening 430 defined by the second closed loop shape of the second strap 425. The second portion 415 of the first strap 405 is not attached to the second strap 425. Instead, the second portion 415 of the first strap 405 is arranged to be movable within the fixed opening 430 defined by the second closed loop shape of the second strap 425.

The first loop shape of the first strap 405 may define a first adjustable opening 435. The size and shape of the first adjustable opening 435 may be adjusted by moving the second portion 415 of the first strap 405 with respect to the fixed opening 430 defined by the second closed loop shape of the second strap 425. Alternatively or in addition, the size and shape of the first adjustable opening 435 may be adjusted by moving the fixed opening 430 defined by the second closed loop shape of the second strap 425 with respect to the second portion 415 of the first strap 405.

For example, the size of the first adjustable opening 435 may be increased by moving the second portion 415 of the first strap 405 through the fixed opening 430 defined by the second closed loop shape of the second strap 425 in a first direction 480. Similarly, the size of the first adjustable opening 435 may be decreased by moving the second portion 415 of the first strap 405 through the fixed opening 430 defined by the second closed loop shape of the second strap 425 in a second direction 485 that is different from the first direction 480. The second direction 485 may be the opposite direction of the first direction 480. A force may be applied in the second direction 485 via the third closed loop shape of the third strap 445. For example, the force may adjust the size of the first adjustable opening 435 such that the portion of the first strap 405 defining the first adjustable opening 435 fits securely around an appendage of a user that has been inserted through the first adjustable opening 435. Second portion 415 of first strap 405 and the third closed loop shape of the third strap 445 provide a path 490. As discussed for FIGS. 2-3 and 5-6, a connector may be connected to the third closed loop shape for coupling to additional exercise equipment. The force applied from the wrist or ankle of the user is transmitted along path 490 to the additional exercise equipment. The force moves second portion 415 of first strap 405 within fixed opening 430 defined by the second closed loop shape to tighten the first adjustable opening 435 on the wrist or ankle of the user, eliminating the need to use the hand.

The first adjustable opening 435 may be configured to accommodate an appendage of a user when the first adjustable opening 435 is adjusted to a minimum size. For example, the first adjustable opening 435 may be configured to accommodate a wrist, ankle, foot, or neck of the user. The length of the first strap 405 and/or the location of the first portion 410 of the first strap 405 where the second strap 425 is affixed may define a range of minimum sizes of the first adjustable opening 435. Because the first strap 405 can be made longer or shorter, and the location where the second strap 425 may be affixed to the first strap 405 can be varied, appendages having different sizes can be accommodated.

Figure 5:
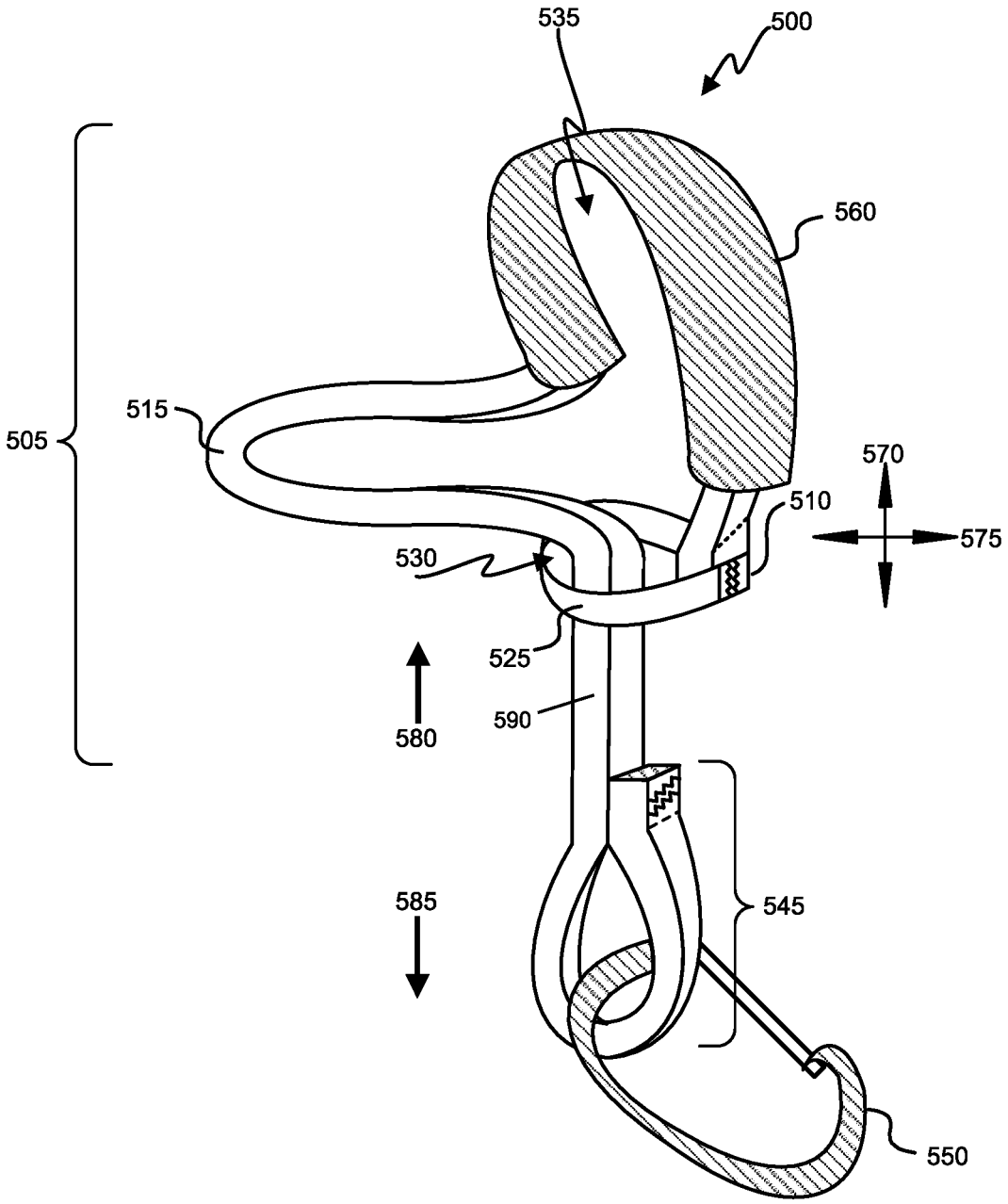
FIG. 5 shows an example of another exercise device according to exemplary embodiments of the invention.

FIG. 5 shows an example of another exercise device 500 according to exemplary embodiments of the invention. As shown in FIG. 5, the exercise device 500 includes a first strap 505 that has a first portion 510 and a second portion 515. The first portion 510 and/or the second portion 515 of the first strap 505 may form a first loop shape. The first loop shape may include an opening. The first strap 505 may be made of a flexible material, such as nylon, cotton, polyester, and/or leather. The flexible material may have sufficient strength to withstand a force that is applied while using the exercise device 500 to perform an exercise.

The first portion 510 of the first strap 505 may be affixed to a second strap 525 that forms a second closed loop shape, as shown in FIG. 5. The first portion of the first strap 505 may be affixed to the second strap 525 by a fastener, such as stitching and/or glue. The fastener may extend over an entire vertical length of the second strap 525. The second portion 415 of the first strap 405 may extend from the top edge of the first portion 410 of the first strap 405 to a junction with a third strap 445.

Alternatively, the first portion 510 of the first strap 505 may be integral with the second strap 525. In this example, the second strap 525 is a continuation of the first portion 510 of the first strap 505. The second closed loop shape may be formed by looping the end of the first portion 510 of the first strap 505 around the second portion 515 of the first strap 505, and affixing the end of the first portion 510 of the first strap 505 to another section of the first portion 510 of the first strap 505. Further, the end of the first portion 510 of the first strap 505 may be affixed to the other section of the first portion 510 of the first strap 505 by a fastener, such as stitching and/or glue.

The second strap 525 may be made of a flexible material, such as nylon, cotton, polyester, and/or leather. The second closed loop shape of the second strap 525 may be secured by a fastener, such as stitching and/or a metal snap. For example, two ends of the second closed loop shape of the second strap 525 may be stitched together or held together by a metal snap with a male component on the first end of the second closed loop shape of the second strap 525 and a female component on the second end of the second closed loop shape of the second strap 525. Alternatively, any other fastener that is capable of fastening the first end of the second closed loop shape of the second strap 525 to the second end of the second closed loop shape of the second strap 525 may be used.

The second closed loop shape of the second strap 525 may define a fixed opening 530. Once the first end of the second closed loop shape of the second strap 525 has been affixed to the second end of the second closed loop shape of the second strap 525, the shape of the fixed opening 530 is constrained by the extent of the second closed loop shape of the second strap 525. Because the second strap 525 may be made of a flexible material, the shape of the fixed opening 530 may be altered somewhat by applying pressure to a portion of the second strap 525, such as by squeezing opposing portions of the second closed loop shape of the second strap 525 together. However, the basic shape and size of the fixed opening 530 may remain the same as determined by the length of the second closed loop shape of the second strap 525.

The second strap 525 may be affixed to the first portion 510 of the first strap 505 such that the second strap 525 is arranged in a plane that is generally perpendicular to a first axis 570, as shown in FIG. 5. The first axis 570 may be parallel to the vertical axis of the device 500. Alternatively, the second strap 525 may be affixed to the first portion 510 of the first strap 505 such that the second strap 525 is arranged in a plane that is generally perpendicular to a second axis 575 and parallel to the first axis 570.

The second portion 515 of the first strap 505 may be affixed to or integrated with the third strap 545, which forms a third closed loop shape. The second portion 515 of the first strap 505 may be affixed to the third strap 545 by fasteners, such as stitching and/or glue. The fasteners may extend over a portion of the vertical length of the third strap 545. Alternatively, the second portion 515 of the first strap 505 may form the third strap 545, as shown in FIG. 5. The third closed loop shape may be configured to receive a connector 550 such as a hook, clip, and/or carabineer. The connector 550 may be used to connect the exercise device 500 to exercise equipment such as dumbbells, barbells, plates, and/or chains.

The third strap 545 may be made of a flexible material, such as nylon, cotton, polyester, and/or leather. The flexible material may have sufficient strength to withstand a force that is applied while using the exercise device 500 to perform an exercise. The third closed loop shape of the third strap 545 may be secured by a fastener, such as stitching and/or a metal snap. For example, two ends of the third closed loop shape of the third strap 545 may be stitched together or held together by a metal snap with a male component on the first end of the third closed loop shape of the third strap 545 and a female component on the second end of the third closed loop shape of the third strap 545. Alternatively, any other fastener that is capable of fastening the first end of the third closed loop shape of the third strap 545 to the second end of the third closed loop shape of the third strap 545 may be used.

The third closed loop shape may be formed by looping the end of the second portion 515 of the first strap 505 and affixing the end of the second portion 515 of the first strap 505 to another section of the second portion 515 of the first strap 505. Further, the end of the second portion 515 of the first strap 505 may be affixed to the other section of the second portion 515 of the first strap 505 by a fastener, such as stitching and/or glue.

The second portion 515 of the first strap 505 may be threaded through the fixed opening 530 defined by the second closed loop shape of the second strap 525. The second portion 515 of the first strap 505 is not attached to the second strap 525. Instead, the second portion 515 of the first strap 505 is arranged to be movable within the fixed opening 530 defined by the second closed loop shape of the second strap 525.

The first loop shape of the first strap 505 may define a first adjustable opening 535. The size and shape of the first adjustable opening 535 may be adjusted by moving the second portion 515 of the first strap 505 with respect to the fixed opening 530 defined by the second closed loop shape of the second strap 525. Alternatively or in addition, the size and shape of the first adjustable opening 535 may be adjusted by moving the fixed opening 530 defined by the second closed loop shape of the second strap 525 with respect to the second portion 515 of the first strap 505.

For example, the size of the first adjustable opening 535 may be increased by moving the second portion 515 of the first strap 505 through the fixed opening 530 defined by the second closed loop shape of the second strap 525 in a first direction 580. Similarly, the size of the first adjustable opening 535 may be decreased by moving the second portion 515 of the first strap 505 through the fixed opening 530 defined by the second closed loop shape of the second strap 525 in a second direction 585 that is different from the first direction 580. The second direction 585 may be the opposite direction of the first direction 580. A force may be applied in the second direction 585 via the third closed loop shape of the third strap 545. For example, the force may adjust the size of the first adjustable opening 535 such that the portion of the first strap 505 defining the first adjustable opening 535 fits securely around an appendage of a user that has been inserted through the first adjustable opening 535. Second portion 515 of first strap 505 and the third closed loop shape of the third strap 545 provide a path 590 from connector 550 when coupled to the additional exercise equipment. The force applied from the wrist or ankle of the user is transmitted along path 590 to the additional exercise equipment. The force moves second portion 515 of first strap 505 within fixed opening 530 defined by the second closed loop shape to tighten the first adjustable opening 535 on the wrist or ankle of the user, eliminating the need to use the hand.

The first adjustable opening 535 may be configured to accommodate an appendage of a user when the first adjustable opening 535 is adjusted to a minimum size. For example, the first adjustable opening 535 may be configured to accommodate a wrist, ankle, foot, or neck of the user. The length of the first strap 505 and/or the location of the first portion 510 of the first strap 505 where the second strap 525 is affixed may define a range of minimum sizes of the first adjustable opening 535. Because the first strap 505 can be made longer or shorter, and the location where the second strap 525 may be affixed to the first strap 505 can be varied, appendages having different sizes can be accommodated.

As shown in FIG. 5, the exercise device 500 may include a flexible material 560 that covers a section of the second portion 515 of the first strap 505. The flexible material 560 may include a padded material such as neoprene, foam, and/or rubber. The flexible material 560 may cover a section of the second portion 515 of the first strap 505 that is adjacent to the first adjustable opening 535. For example, the flexible material 560 may extend along a section of the second portion 515 of the first strap 505 starting from the top of the first portion 510 of the first strap 505. Alternatively, the flexible material 560 may cover a larger portion or an entire length of the first strap 505, and may contain a slit (not shown) through which the first strap 505 is threaded. The flexible material 560 may have a length that allows access to the third closed loop shape of the third strap 545. A surface of the flexible material 560 that faces the first adjustable opening 535 may be smooth.

The flexible material 560 may be affixed to the second portion 515 of the first strap 505 by a fastener, such as stitching and/or glue. The flexible material 560 may be affixed to the second portion 515 of the first strap 505 at a single location adjacent to the first portion 510 of the first strap 505. Alternatively or in addition, the flexible material 560 may be affixed to the second portion 515 of the first strap 505 at multiple locations.

Figure 6:
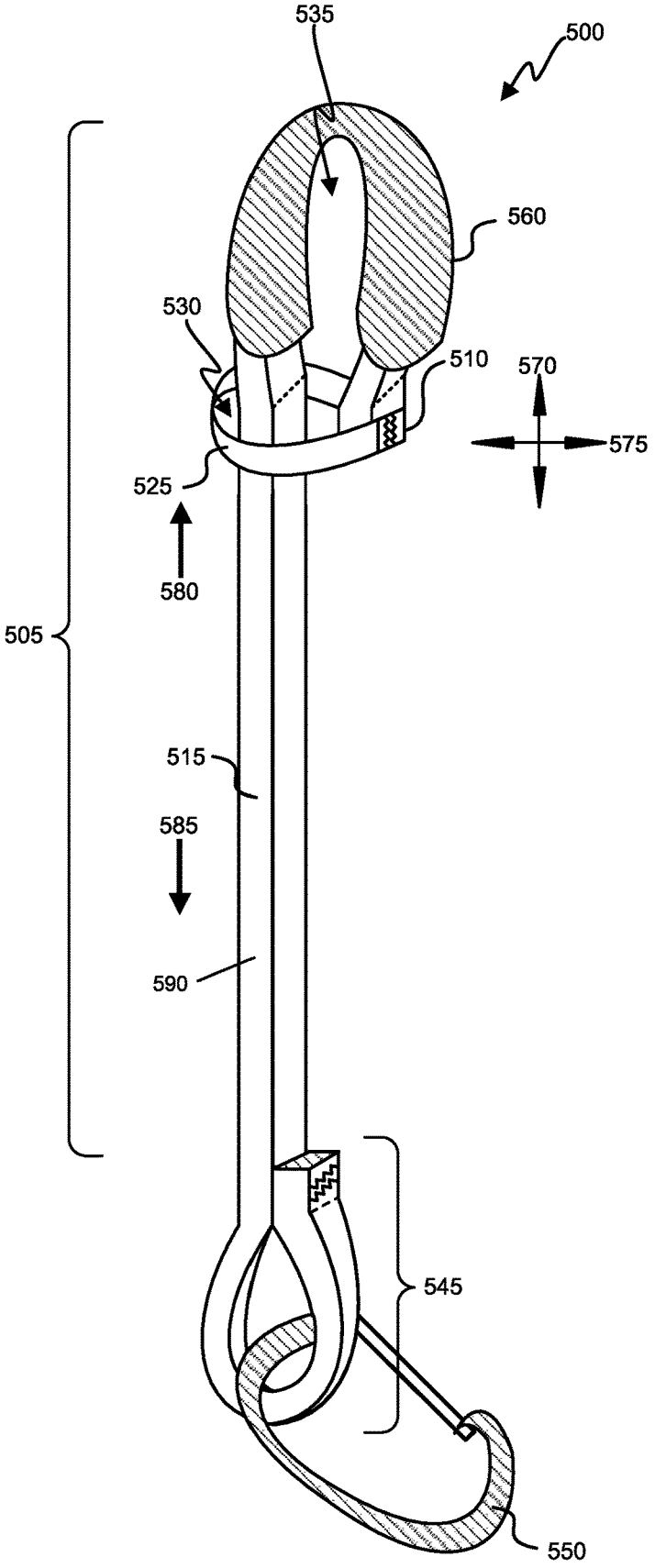
FIG. 6 shows an example of the exercise device of FIG. 5 in another configuration.

FIG. 6 shows an example of the exercise device 500 shown in FIG. 5 in another configuration. As shown in FIG. 6, the first adjustable opening 535 has a reduced size compared with the first adjustable opening 535 in FIG. 6. The first adjustable opening 535 may have been decreased by moving the second portion 515 of the first strap 505 through the fixed opening 530 defined by the second closed loop shape along the second direction 585. The second portion 515 of the first strap 505 may have been moved through the fixed opening 530 defined by the second closed loop shape along the second direction 585 by applying a force to the third closed loop shape of the third strap 545. Alternatively or in addition, the force may have been applied through the connector 550 that is connected to the third closed loop shape of the third strap 545.

Specific details are given in the above description to provide a thorough understanding of the embodiments. However, it is understood that the embodiments may be practiced without these specific details. For example, structures may be shown in simplified diagrams in order not to obscure the embodiments in unnecessary detail. In other instances, well-known processes, structures, and techniques may be shown without unnecessary detail in order to avoid obscuring the embodiments.

While the principles of the disclosure have been described above in connection with specific apparatuses and methods, it is to be clearly understood that this description is made only by way of example and not as limitation on the scope of the disclosure.

What is claimed is:

1. An exercise device configured for attaching to a wrist adjacent a hand of a user to eliminate a need to use the hand in exercising, the device configured for connection to additional exercise equipment, the device comprising:

a first strap that has a first loop shape configured to receive the wrist of the user;

a second strap that has a second closed loop shape defining a fixed opening; and a third closed loop shape configured for connection to the additional exercise equipment for application of force from the wrist of the user to the additional exercise equipment, wherein:

a first portion of the first strap is affixed to or integral with the second strap at a first location of the first portion of the first strap, a second portion of the first strap is arranged to be movable within the fixed opening defined by the second closed loop shape, the second portion of the first strap is affixed to or integral with the third closed loop shape strap, and a first adjustable opening within the first loop shape is configured to be adjusted by changing a relative position of the second portion of the first strap and the fixed opening defined by the second closed loop shape, and wherein the force applied from the wrist of the user to the additional exercise equipment moves the second portion of the first strap within the fixed opening defined by the second closed loop shape to tighten the first adjustable opening on the wrist of the user to eliminate the need to use the hand, wherein the first strap includes a third portion extending between the first location and the third closed shape, the first location and the third portion determining a minimum size of the first adjustable opening wherein the minimum size of the first adjustable opening is sized to accommodate the user's wrist.

2. The device as recited in claim 1, wherein the first strap includes a third portion having a length extending between the first location and the third closed shape, wherein the length of the third portion provides a limit on movement of the third closed loop shape away from the first adjustable opening to determine the minimum size of the first adjustable opening.

3. The device as recited in claim 1, wherein the adjustable opening consists of only a single loop to receive the user's wrist.

4. The device as recited in claim 1, wherein the second strap comprises at least one of nylon, cotton, polyester, or leather.

5. The device as recited in claim 1, further comprising a flexible material that covers a section of the second portion of the first strap, wherein the section of the second portion of the first strap is adjacent to the first adjustable opening.

6. The device as recited in claim 5, wherein the flexible material comprises neoprene.

7. The device as recited in claim 5, wherein a surface of the flexible material that faces the first adjustable opening is smooth.

8. The device as recited in claim 1, wherein the second portion of the first strap is integral with the third closed loop shape.

9. The device as recited in claim 1, wherein the third closed loop shape is configured to receive a connector.

10. The device as recited in claim 9, wherein the connector is a hook, a clip, or a carabineer.

11. The device as recited in claim 1, wherein the third closed loop shape is formed by attaching the second portion of the first strap to a third portion of the first strap.

12. The device as recited in claim 1, wherein the second closed loop shape is secured by a stitching.

13. The device as recited in claim 1, wherein the second closed loop shape is secured by a metal snap fastener.

14. The device as recited in claim 1, wherein the first adjustable opening is configured to accommodate an appendage of a body when the first adjustable opening is adjusted to the minimum size.

15. A method for a user to exercise, the method including applying force at a wrist adjacent a hand of a user and not using the hand of the user, the method comprising:

inserting the wrist of the user in a first adjustable opening within a first loop shape of a first strap;

adjusting the first adjustable opening within the first loop shape of the first strap by changing a relative position of the first strap with respect to a fixed opening defined by a second closed loop shape of a second strap, wherein:

a first portion of the first strap is attached to or integral with the second strap at a first location of the first portion of the first strap, a second portion of the first strap is arranged to be movable within the fixed opening defined by the second closed loop shape of the second strap, and adjusting the first adjustable opening comprises applying a force to a third closed loop shape that is affixed to or integral with the second portion of the first strap and connecting the third closed shape to additional exercise equipment, wherein the second portion of the first strap and the third closed loop shape provide a path for the force from the additional exercise equipment to the first loop shape to move the second portion of the of the first strap within the fixed opening defined by the second closed loop shape to tighten the first adjustable opening on the wrist of the user, wherein the minimum size of the first adjustable opening is sized to accommodate the user's wrist and, wherein the first strap includes a third portion extending between the first location and the third closed loop shape, the first location and the third portion determining a minimum size of the first adjustable opening wherein the minimum size of the first adjustable opening is sized to accommodate the user's wrist.

16. The method as recited in claim 15, wherein the third portion has a length providing a limit on movement of the third closed loop shape away from the first adjustable opening to determine the minimum size of the first adjustable opening.

17. An exercise device configured for attaching to an ankle of a user, the device configured for connection to additional exercise equipment, the device comprising:

a first strap that has a first loop shape configured to receive the ankle of the user;

a second strap that has a second closed loop shape defining a fixed opening; and a third closed loop shape configured for connection to the additional exercise equipment for application of force from the ankle of the user to the additional exercise equipment, wherein:

a first portion of the first strap is affixed to or integral with the second strap at a first location of the first portion of the first strap, a second portion of the first strap is arranged to be movable within the fixed opening defined by the second closed loop shape, the second portion of the first strap is affixed to or integral with the third closed loop shape strap wherein the second portion of the first strap and the third closed loop shape provide a path from the additional exercise equipment to the first loop shape, and a first adjustable opening within the first loop shape is configured to be adjusted by changing a relative position of the second portion of the first strap and the fixed opening defined by the second closed loop shape, and wherein the force applied from the ankle of the user along the path provided by the second portion of the first strap and the third closed loop shape to the additional exercise equipment moves the second portion of the first strap within the fixed opening defined by the second closed loop shape to tighten the first adjustable opening on the ankle of the user, and wherein the first location of the first portion of the first strap where the second strap is affixed defines a minimum size of the first adjustable opening, the minimum size being sized to accommodate the user's ankle, and wherein the first strap includes a third portion extending between the first location and the third closed shape, the first location and the third portion determining the minimum size of the first adjustable opening.

18. The device as recited in claim 17, further comprising a flexible material that covers a section of the second portion of the first strap, wherein the section of the second portion of the first strap is adjacent to the first adjustable opening.

19. The device as recited in claim 18, wherein the flexible material comprises neoprene.

20. The device as recited in claim 17, wherein the third closed loop shape is configured to receive a connector.

21. The device as recited in claim 20, wherein the connector is a hook, a clip, or a carabineer.

22. The device as recited in claim 17, wherein the second closed loop shape is secured by a stitching.

* * * * *